US011235191B2

(12) United States Patent
Krull et al.

(10) Patent No.: US 11,235,191 B2
(45) Date of Patent: Feb. 1, 2022

(54) HAND-HELD EXERCISE FREE WEIGHTS

(71) Applicants: Mark A. Krull, New Braunfels, TX (US); Darrin M. Swagel, Minnetonka, MN (US)

(72) Inventors: Mark A. Krull, New Braunfels, TX (US); Darrin M. Swagel, Minnetonka, MN (US)

( * ) Notice: Subject to any disclaimer, the term of this patent is extended or adjusted under 35 U.S.C. 154(b) by 0 days.

(21) Appl. No.: 15/788,565

(22) Filed: Oct. 19, 2017

(65) Prior Publication Data

US 2019/0118025 A1 Apr. 25, 2019

(51) Int. Cl.

| | |
|---|---|
| ***A63B 21/06*** | (2006.01) |
| ***A63B 21/072*** | (2006.01) |
| ***A63B 23/12*** | (2006.01) |
| ***A63B 21/00*** | (2006.01) |

(52) U.S. Cl.

CPC ..... *A63B 21/0604* (2013.01); *A63B 21/072* (2013.01); *A63B 21/4035* (2015.10); *A63B 23/1209* (2013.01); *A63B 23/1254* (2013.01); *A63B 23/1263* (2013.01); *A63B 23/1272* (2013.01); *A63B 2209/00* (2013.01)

(58) Field of Classification Search

CPC ... A63B 21/072; A63B 21/601; A63B 21/604; A63B 21/06–08; A63B 19/00–04; A63B 21/4035; A63B 23/1209; A63B 23/1254; A63B 23/1263; A63B 23/1272; A63B 2209/00; A63B 21/4019; A63B 21/4021

See application file for complete search history.

(56) References Cited

U.S. PATENT DOCUMENTS

| | | | | | |
|---|---|---|---|---|---|
| 2,633,358 | A | | 3/1953 | Wright | |
| 3,502,329 | A | * | 3/1970 | Brazier | A63B 21/4015 482/109 |
| 3,594,945 | A | * | 7/1971 | Turney | A63H 33/18 446/48 |
| 3,659,849 | A | * | 5/1972 | Seymour | A63B 67/086 473/514 |
| 3,780,469 | A | * | 12/1973 | Hancovsky | A63H 33/065 446/127 |
| 3,814,288 | A | | 6/1974 | Westrich | |
| D268,437 | S | * | 3/1983 | Giordano | D21/682 |
| 4,380,885 | A | * | 4/1983 | Komagata | A63B 19/00 403/383 |
| 4,560,358 | A | * | 12/1985 | Adler | A63H 33/18 244/34 A |
| 4,655,723 | A | * | 4/1987 | Marason, Jr. | A63H 33/00 411/385 |
| 4,703,927 | A | | 11/1987 | Hanzlik | |
| 4,891,900 | A | | 1/1990 | Snyder | |
| 4,898,380 | A | | 2/1990 | Kobrin | |
| 4,946,173 | A | * | 8/1990 | Schlegel | A63B 65/10 473/589 |
| D311,640 | S | | 10/1990 | Grengs | |

(Continued)

OTHER PUBLICATIONS

US Patent Pub. No. 2008/0268278 (Walsh).

*Primary Examiner* — Nyca T Nguyen

(57) ABSTRACT

Various hand-held exercise weights are configured to fit comfortably in a person's hand. Some embodiments define a circular loop about a central opening. Some embodiments have first and second segments that change in girth as a function of distance from a juncture defined therebetween. Some of the embodiments have handgrips of different shapes.

20 Claims, 15 Drawing Sheets

(56) References Cited

U.S. PATENT DOCUMENTS 4,973,043 A 11/1990 Nolan
5,188,266 A 2/1993 Loulias
5,234,367 A * 8/1993 DeCesare ..... A63H 33/18 446/34
D340,759 S * 10/1993 Miller ..... D21/680
5,309,666 A 5/1994 Prince
5,338,244 A * 8/1994 Huang ..... A63B 19/00 446/236
5,450,689 A 9/1995 Glick
D374,047 S * 9/1996 Thielemann ..... D21/682
5,741,206 A * 4/1998 Anastasi ..... A63B 21/0601 482/105
D466,582 S 12/2002 Haney
6,739,934 B1 * 5/2004 Adler ..... A63H 33/18 446/46
D498,813 S 11/2004 Nichols
D518,529 S * 4/2006 Carbonero ..... D21/398
D576,592 S 9/2008 Hsu
D595,387 S 6/2009 Harrison
D598,972 S 8/2009 Voss
D615,605 S 5/2010 Frasco et al.
7,739,910 B2 6/2010 Clem
8,702,572 B1 * 4/2014 Chalk ..... A63B 19/00 446/266
D745,096 S 12/2015 Krull et al.
9,468,790 B1 * 10/2016 Snead ..... A63B 21/0608
9,789,348 B1 10/2017 Krull et al.
D877,825 S * 3/2020 Hodes ..... D21/682
2004/0162199 A1 * 8/2004 Connelly ..... A63B 21/072 482/107
2010/0075819 A1 * 3/2010 Maki ..... A63B 21/0004 482/139
2015/0273260 A1 * 10/2015 Hotchkis ..... A63B 19/00 482/23
2017/0209732 A1 * 7/2017 Polenz ..... A63B 21/4013

* cited by examiner

Fig. 22
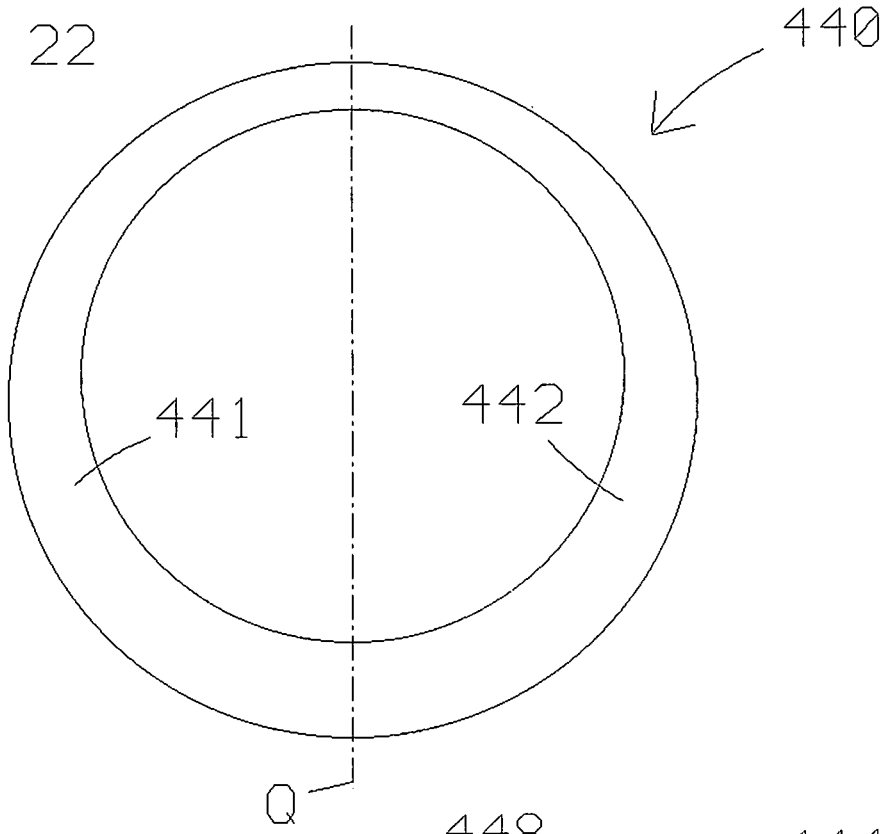
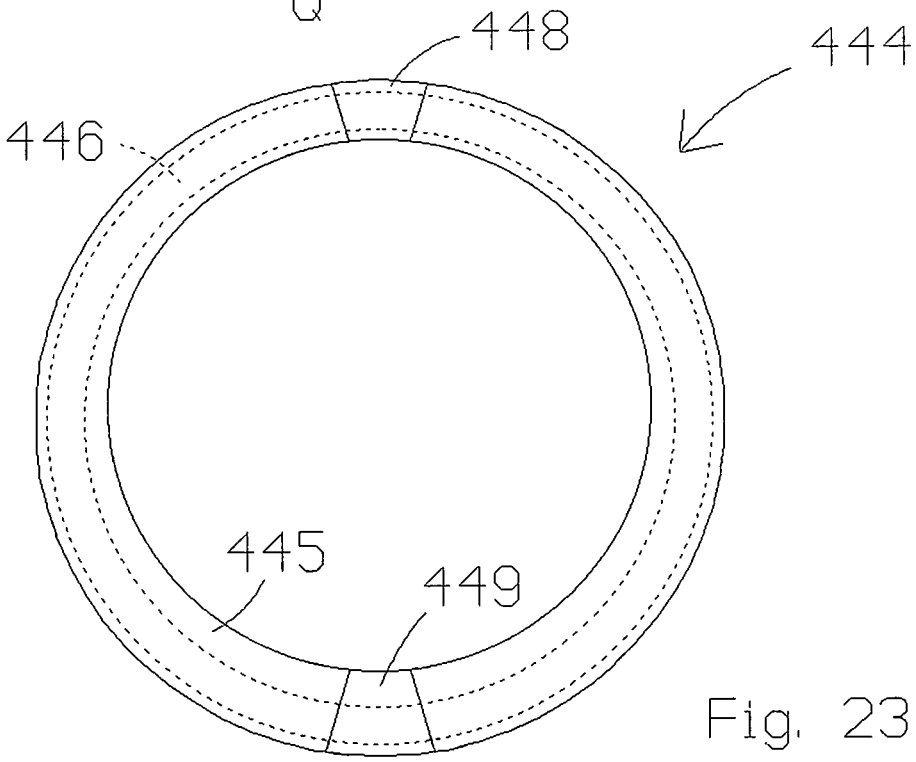
Fig. 23

Fig. 25
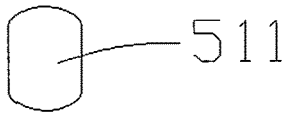
Fig. 24
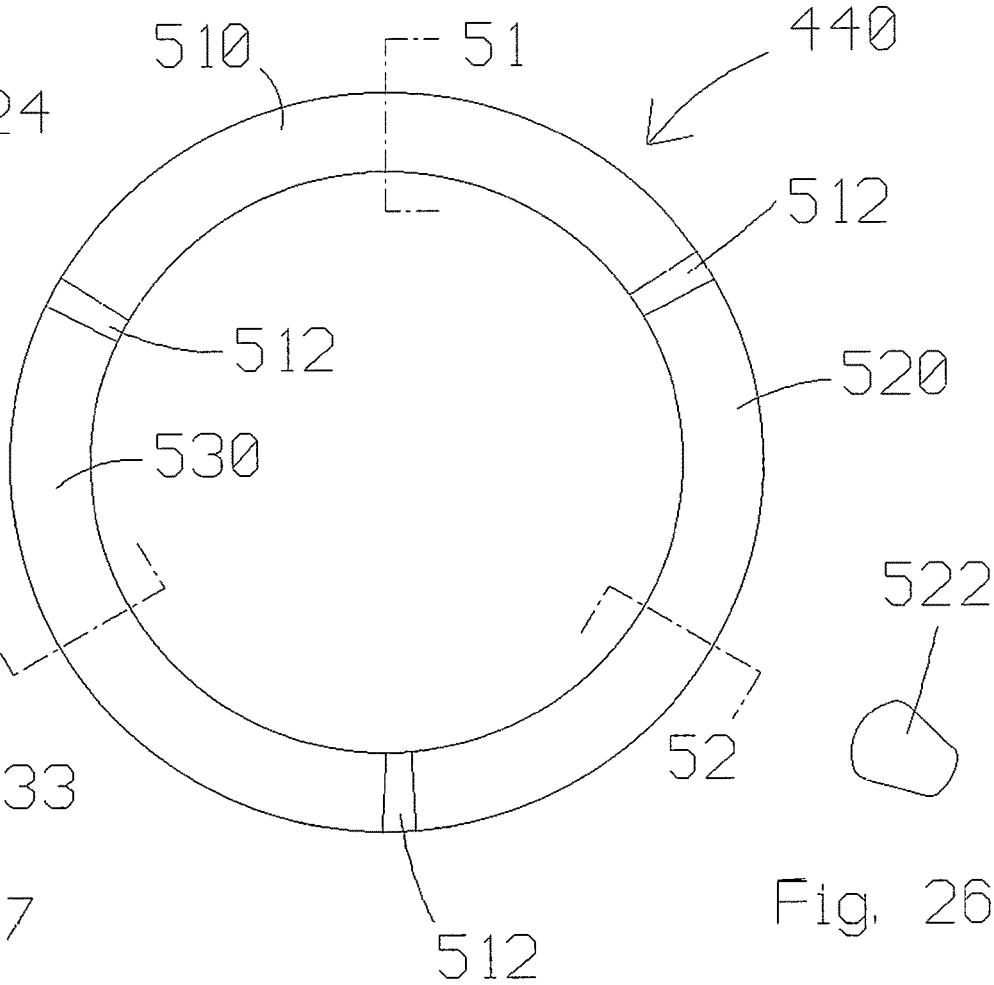
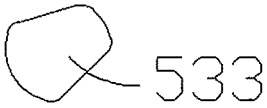
Fig. 27
Fig. 26

HAND-HELD EXERCISE FREE WEIGHTS

FIELD OF THE INVENTION

The present invention relates to exercise equipment and more specifically to hand-held exercise free weights.

BACKGROUND OF THE INVENTION

Various hand-held exercise free weights are well known in the art. Some examples include barbells, dumbbells and kettlebells. Others may be described as hand weights that are held/used during some other form of activity, such as walking. Some examples of the latter are disclosed in U.S. Pat. No. 9,789,348 to Krull et al. An object of the present invention is to provide new and improved hand-held exercise free weights. Another object of the present invention is to provide new and improved free weights to be used/held while performing another activity, such as walking or sitting.

SUMMARY OF THE INVENTION

Certain embodiments of the present invention may be described in terms of a hand-held exercise free weight in the form of a ring that accommodates uninterrupted passage of successive sections of the ring through a user's hand for more than a full revolution of the ring. In other words, a user is able to grasp the ring in his hand and move his hand in a closed loop curve all the way around the ring without ever releasing his grasp on the ring.

Certain embodiments of the present invention may be described in terms of a hand-held exercise free weight having a plurality of discrete grip configurations to provide a user with various grip options in terms of size and/or shape. For example, some embodiments are provided with at least one handgrip segment that gradually tapers from a first end to a second end, and some embodiments are provided with multiple handgrip segments having different cross-sectional profiles.

Additional features and benefits of the present invention will become apparent from the more detailed description that follows.

BRIEF DESCRIPTION OF THE DRAWING

With reference to the Figures of the Drawing, wherein like numerals represent like parts and assemblies throughout the several views.

FIG. 22 is a front view of another weight constructed according to the principles of the present invention;

FIG. 23 is a front view of another weight constructed according to the principles of the present invention;

FIG. 24 is a front view of another weight constructed according to the principles of the present invention;

FIG. 25 is a first cross-sectional profile of the weight of FIG. 24 taken along the section line 51;

FIG. 26 is a second cross-sectional profile of the weight of FIG. 24 taken along the section line 52; and FIG. 27 is a third cross-sectional profile of the weight of FIG. 24 taken along the section line 53.

DETAILED DESCRIPTION OF THE PREFERRED EMBODIMENT

Figure 7:
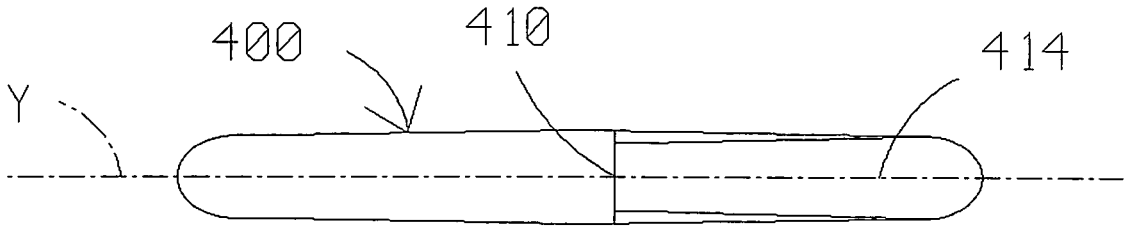
FIG. 7 is a top view of the weight of FIG. 6.
Figure 6:
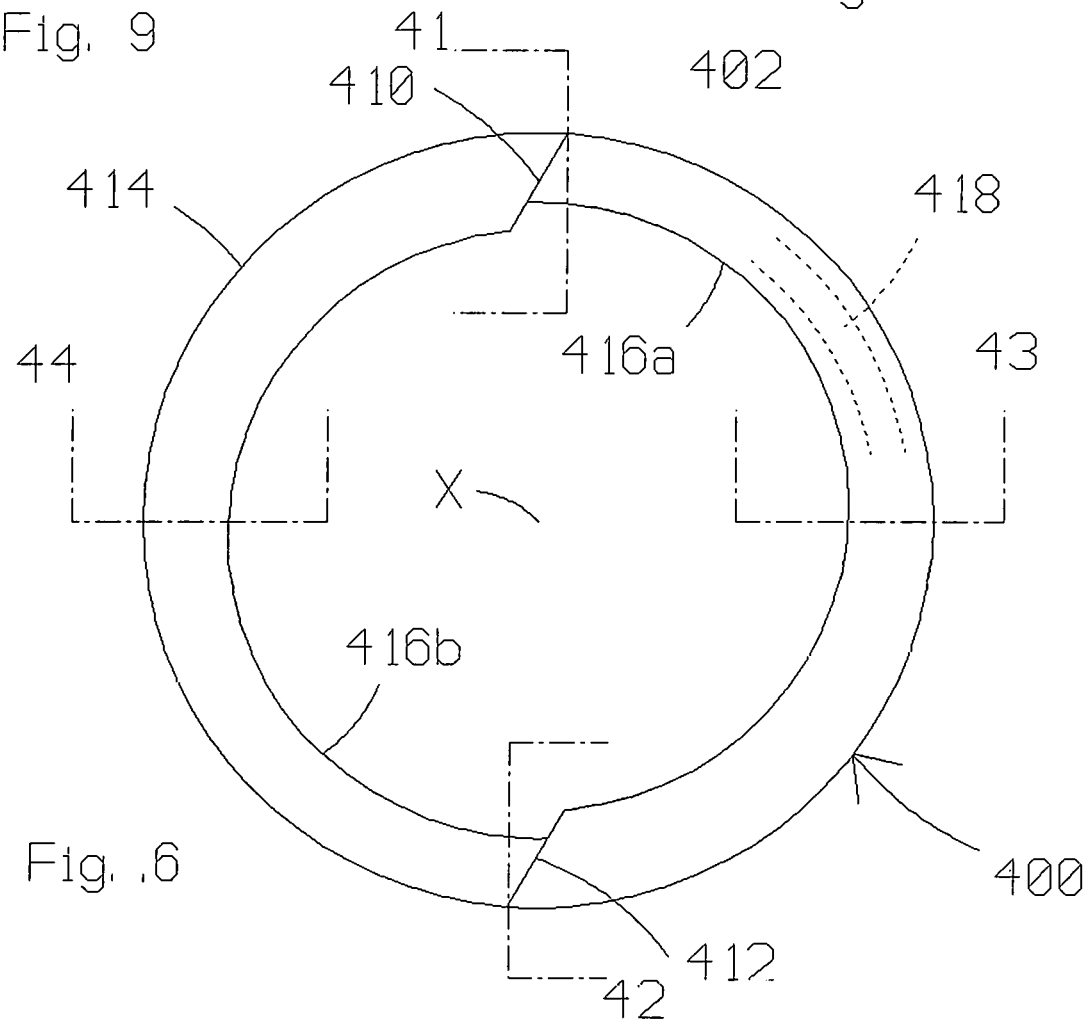
FIG. 6 is a front view of an exercise free weight constructed according to the principles of the present invention.

FIGS. 6-7 show a hand-held exercise free weight 400 constructed according to the principles of the present invention. The weight 400 is preferably a single, solid, unitary piece of cast iron, although alternative embodiments may be made using different materials and/or manufacturing methods. The weight 400 may be described as a bar formed into a closed loop, a circle, and ring, and/or a torus that is preferably sized and configured to have a mass in the range of two pounds to one kilogram. The weight 400 is symmetrical about a plane that is represented by a line Y in FIG. 7.

The weight 400 also may be described as a ring-shaped mass defined between first and second outer arcs and first and second inner arcs. The first and second outer arcs are respective halves of an outer circle 414 having a center point X and a diameter preferably in the range of six to seven inches (and most preferably six and one-half inches). The first and second inner arcs, designated as 416*a* and 416*b* in FIG. 6, are similar half circles, but with respective center points displaced in opposite directions from the center point X. The diameter of each inner arc 416*a* and 416*b* is in the range of four to five and one-half inches (and most preferably four and one-half inches).

The weight 400 also may be described in terms of at least two segments or a plurality of segments, each of which may be described as a copy of the others that has been rotated about the center point X through an angle equal to 360 degrees divided by the number of segments (e.g. 180 degrees in the case of two segments). Each segment preferably has an elliptical cross-section that changes as a function of circumferential displacement about the center point X. Moving in a clockwise direction, the segment bounded by the arc 416*a* gradually increases in circumference from a first interface 410 at 12:00 to a second interface 412 at 6:00. Similarly, the segment bounded by the arc 416*b* gradually increases in circumference from the interface 412 at 6:00 to the interface 410 at 12:00. Each interface 410 and 412 may be described as a break or protrusion defined where the relatively smaller end of one segment abuts the relatively larger end of the adjacent segment.

Figure 9:
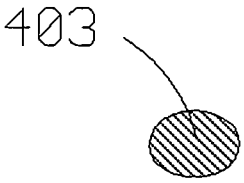
FIG. 9 is a cross-sectional profile of the weight of FIG. 6 taken along either of the section lines 43 or 44 in FIG. 6.
Figure 8:
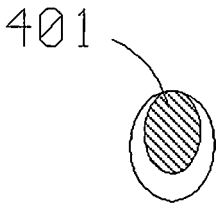
FIG. 8 is a cross-sectional profile of the weight of FIG. 6 taken along either of the section lines 41 or 42 in FIG. 6.

Representing the views taken at both section line 41 and section line 42, FIG. 8 shows both the smallest elliptical cross-section 401 and the largest elliptical cross-section 402. At the smallest cross-section, the major axis of the ellipse is approximately 0.75 inches, and the minor axis of the ellipse is approximately 0.50 inches. At the largest cross-section, the major axis of the ellipse is approximately 1.25 inches, and the minor axis of the ellipse is approximately 0.75 inches. The term "approximately" shall mean plus or minus 10% of the stated dimension. Representing the views taken at both the section line 43 and the section line 44, FIG. 9 shows the median cross-section 403, half-way between the minimum cross-section 401 and the maximum cross-section 402. As suggested by the identical cross-sections 403, any given cross-section of the weight 400 has a diametrically opposed cross-section that is identical in size and shape.

In using the weight 400, a person may elect to hold a first weight 400 in one hand and a second weight 400 in the other hand. The increasing size of the cross-sections allows the person to find her "best fit" hand grip location about the circumference of each weight 400. Also, the person's grip on a single weight 400 may be "adjusted" by reversing orientations of the weight 400 so either the gripped portion tapers in a direction toward her thumb or alternatively tapers in an opposite direction, toward her pinky finger.

For certain exercises, including biceps curls, lateral arm raises, forward arm raises, shoulder shrugs, and/or fore-to-aft arm swings, the person may begin by holding the weights 400 at the end of her downwardly extending arms. For other exercises, including military presses, the person may hold the weights 400 at shoulder height, and at the military press extension position, the person may perform triceps extensions by bending her elbows to allow the weights to drop behind her head.

The weight 400 also may be held in alternative orientations during many of the exercises described above. For example, the person may rotate the weight approximately 180 degrees in a first direction about the gripped portion to bring the weight 400 up against the inside of her forearm. Yet another option is for the person to rotate the weight approximately 160 degrees in an opposite, second direction about the gripped portion to bring the weight 400 up against the outside of her forearm.

Some of the foregoing exercises may alternatively be performed with the person's hands grasping opposite sides of a single weight 400, in which case, the two halves of the weight 400 are configured to provide similarly sized handgrips at any pair of diametrically opposed locations along the circumference of the weight 400 (though with the tapers of the handgrips extending in opposite directions relative to the person's left and right hands).

Isometric exercises also may be performed with the person's hands grasping opposite sides of a single weight 400. For example, the person may position the weight 400 in front of her chest and either attempt to push her hands toward one another or attempt to pull her hands away from one another. Similarly, the person may position the ring behind her head and attempt to pull her hands away from one another. The weight 400 is rigid enough to retain its shape when diametrically opposed forces of fifty pounds are applied against diametrically opposed, outwardly facing portions of the weight 400.

While performing certain exercises, especially arm swings while walking, the person may encourage the weight 400 to "hang" downward from her hand and rotate about its center point X (especially during the forward arm swing) while she maintains a relaxed grip on the weight 400. In this regard, the circular nature of the weight 400 accommodates uninterrupted rotation of the weight through a complete revolution in the person's hand. If desired, the person may "feel for" encounters with the interfaces 410 and 412, which may act as stops at successive one-half revolutions of the weight 400. This feature is one example of how the weight 400 may encourage a user to perform relatively more upper body exercise while walking.

FIG. 6 depicts part of an optional flat surface 418 (shown in dashed lines) that may be cut into the front face of the weight 400. When implemented, this flat surface 418 extends in a half-circle around the center point X (and a similar flat surface may be provided on the opposite half of the weight 400, though not in the same plane). Although the flat surface 418 is relatively subtle, an asymmetrical profile allows a person to choose between two different grips. For example, a user may orient the weight 400 so the flat surface 418 faces toward her palm or alternatively away from her palm. In addition, the flat surfaces 418 may facilitate stacking of two complementary weights (as further described below with reference to the weights 460 and 470).

The weight 400 also may be described in terms of a first segment (the portion bounded by the arc 416*a*), a second segment (the portion bounded by the arc 416*b*), a first juncture of integral interconnection between the first segment and the second segment (a wedge of material disposed between the interface line 410 and an extension of the section line 42), and a second juncture of integral interconnection between the first segment and the second segment (a wedge of material disposed between the interface line 412 and an extension of the section line 41). The girth or cross-sectional circumference of the weight 400 is maximum and minimum on respective sides of each of these junctures, and each segment changes in girth as a function of distance from a respective one of the junctures and/or as a function of angular displacement about the center point X.

Figure 10:
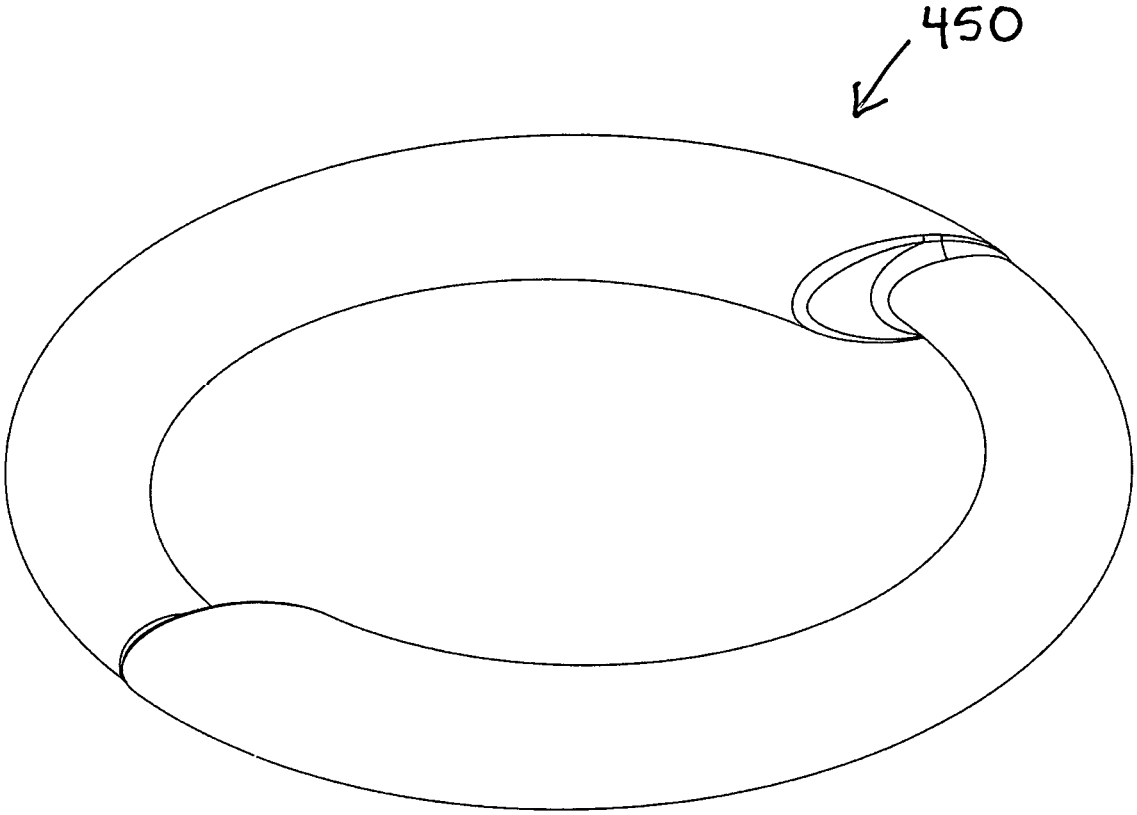
FIG. 10 is a perspective view of a slightly refined version of the weight of FIG. 6.
Figures 11A, 11B, 11C, 11D, 11E, 11F:
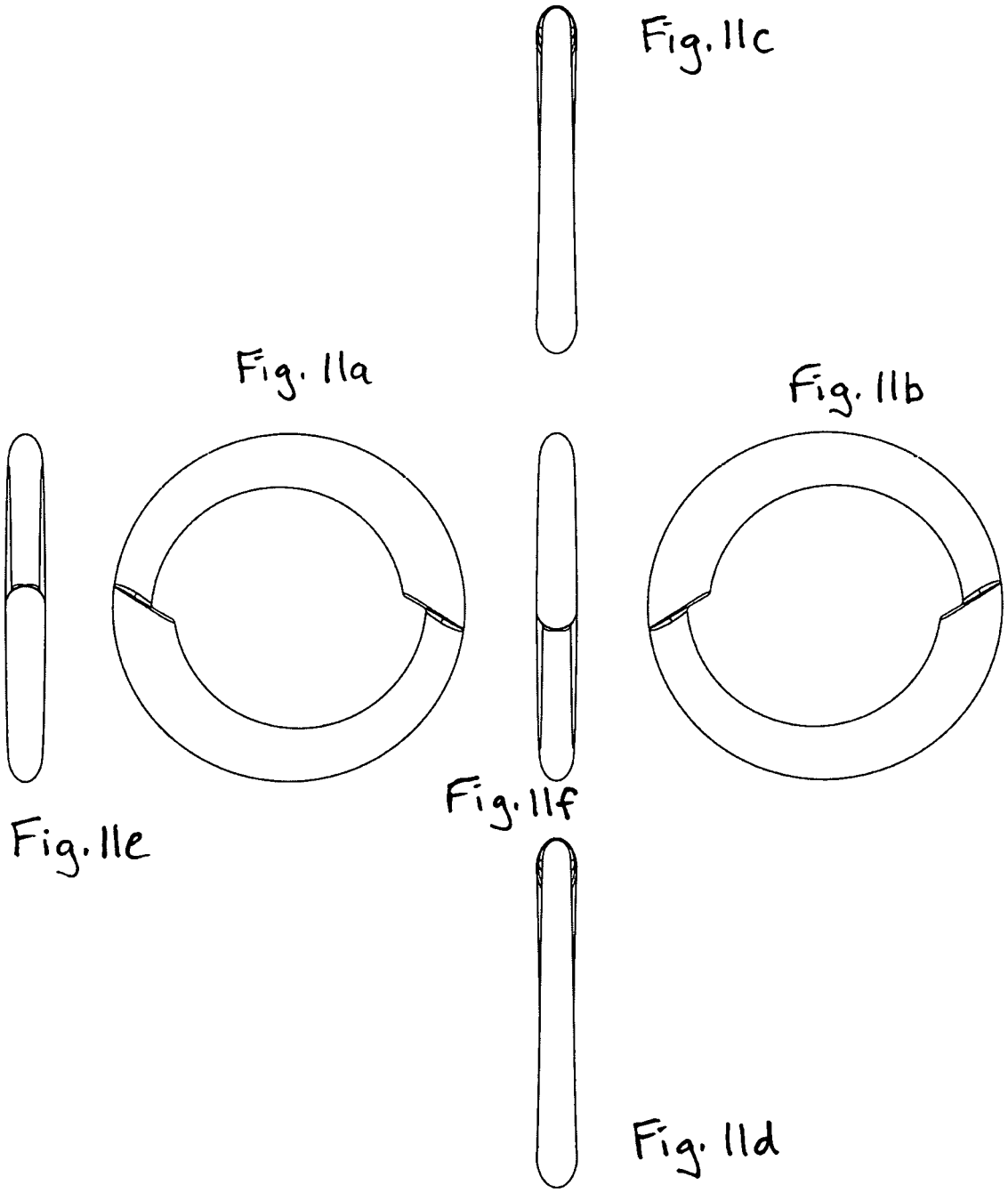
FIG. 11*a* is a front view of the weight of FIG. 10.
FIG. 11*b* is a back view of the weight of FIG. 10.
FIG. 11*c* is a top view of the weight of FIG. 10.
FIG. 11*d* is a bottom view of the weight of FIG. 10; Figure lie is a side view of the weight of FIG. 10.
FIG. 11*f* is an opposite side view of the weight of FIG. 10.
Figure 12:
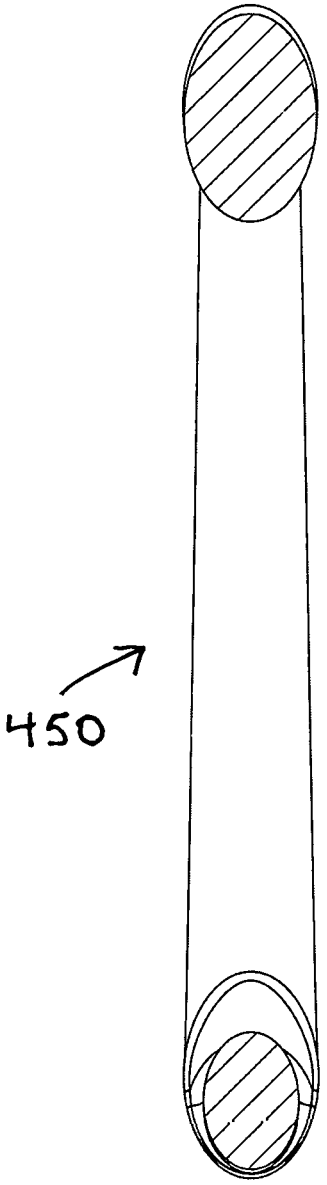
FIG. 12 is a sectioned side view of the weight of FIG. 10.

FIGS. 10-12 show a weight 450 that may be described as a very similar, but more refined version of the weight 400, primarily in terms of more rounded corners. FIGS. 11*a*-11*f* show the six standard orthogonal views of the weight 450. FIG. 12 is a sectioned view of the weight 450 taken along a plane extending just to one side of both interfaces. The section is taken perpendicular to the circle defined by the weight 450, and passes through the larger end of one segment (shown at the top of FIG. 12), and through the smaller end of the other segment (shown at the bottom of FIG. 12).

Figure 13:
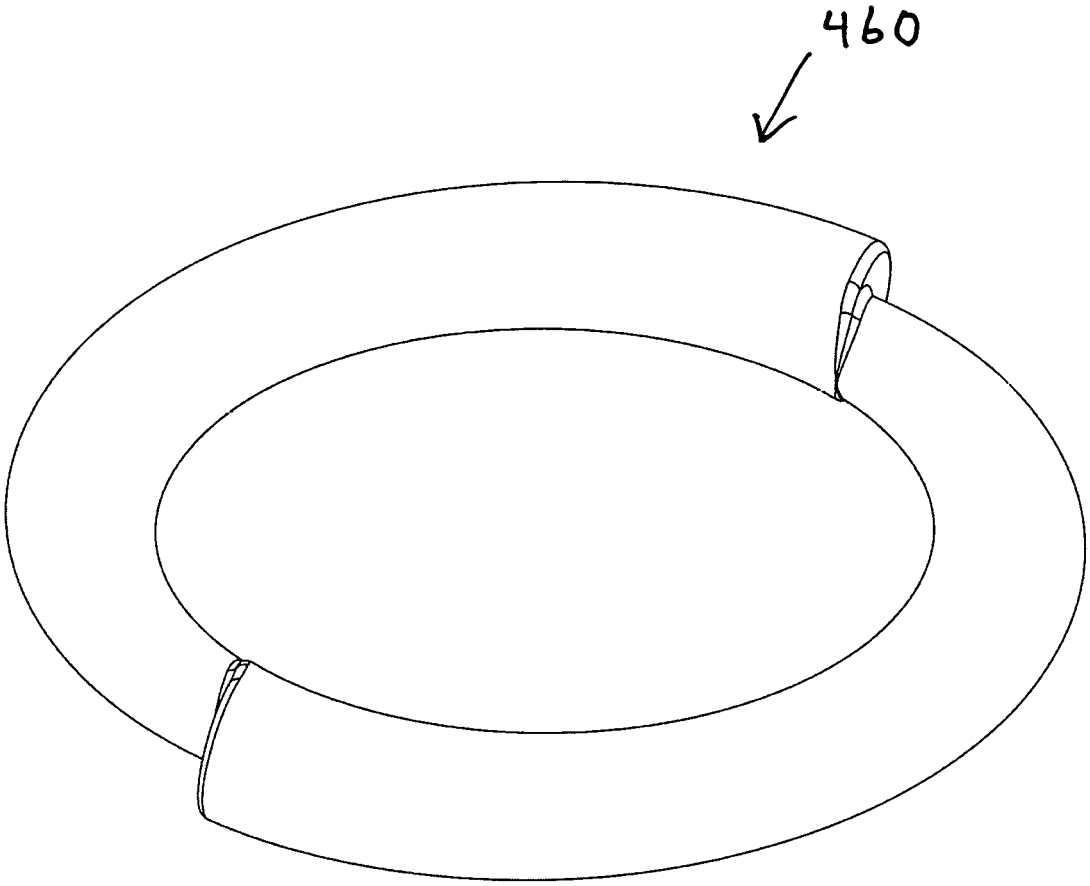
FIG. 13 is a perspective view of another weight constructed accordingly to the principles of the present invention.
Figure 14:
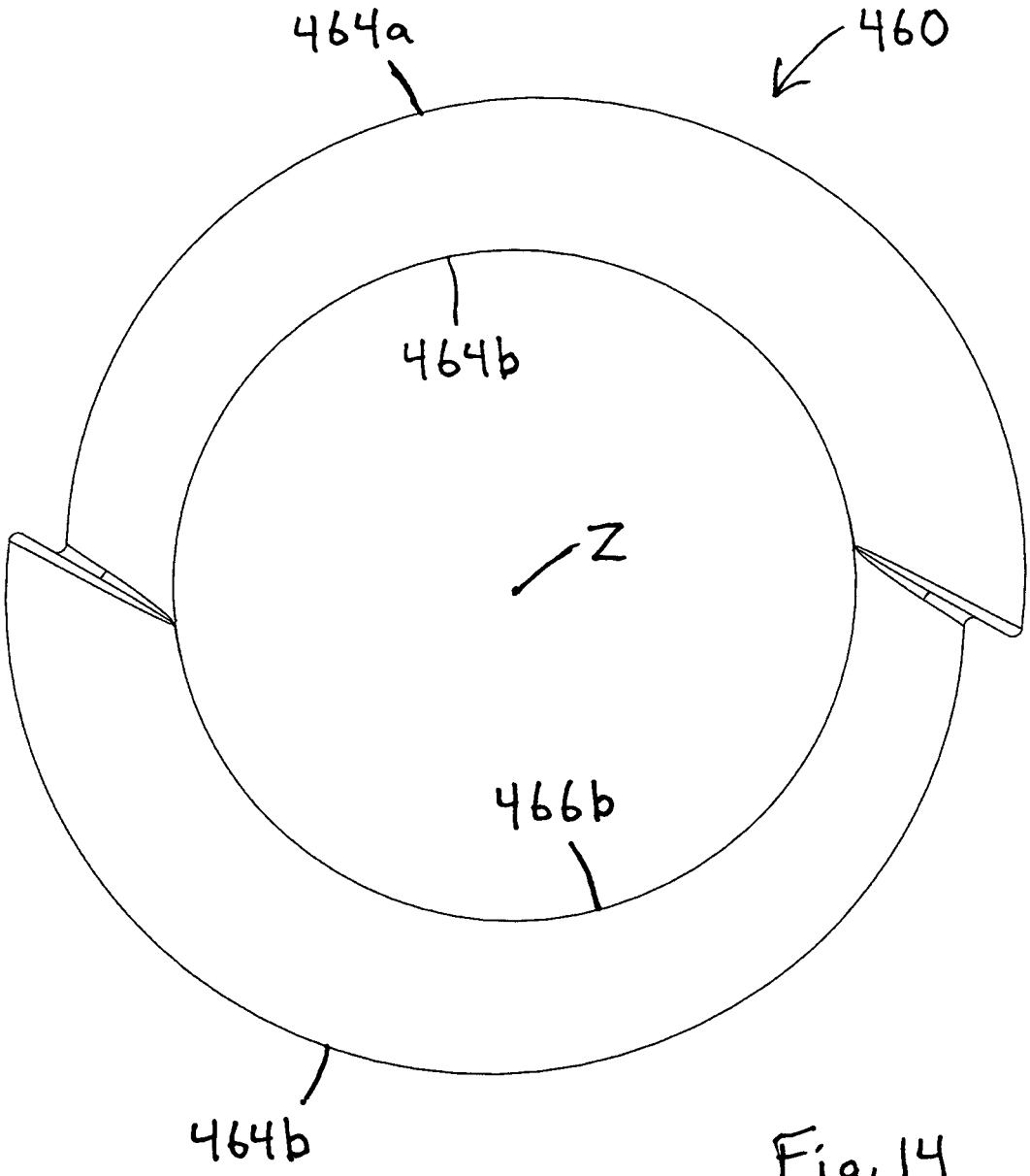
FIG. 14 is a front view of the weight of FIG. 13.

Alternative embodiments of the weights 400 and 450 may be made by rearranging the inner arcs and the outer arcs relative to one another to shift the protrusions of the interfaces 410 and 412 from entirely inboard to at least partially outboard. For example, FIGS. 13-14 show a weight 460 having inner arcs 466*a* and 466*b* that cooperate to form a circle centered about a center point Z, and outer arcs 464*a* and 464*b* that are jogged relative to one another and the center point Z. In all other respects, the weight 460 is identical to the weight 450. In another words, the subject invention also may be described in terms of horn-shaped handgrip segments that are arranged end to end in various ways to define rings having various protrusions.

Figure 17:
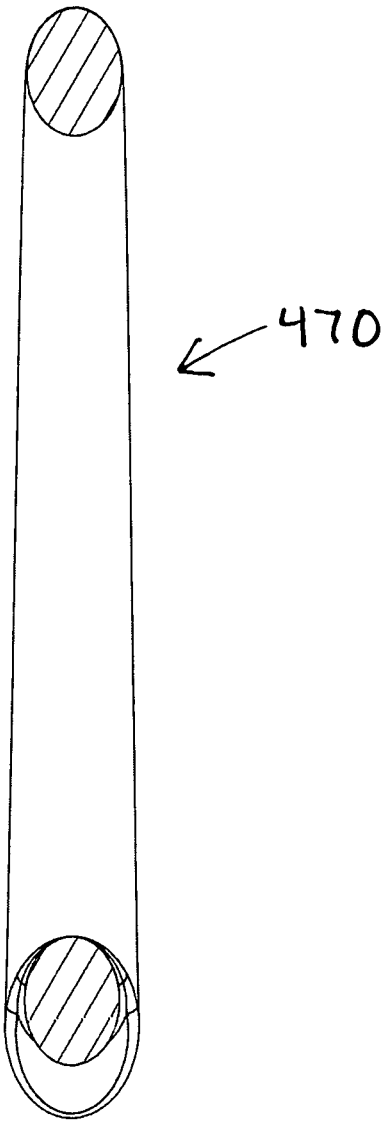
FIG. 17 is a sectioned side view of the weight of FIG. 15.
Figure 15:
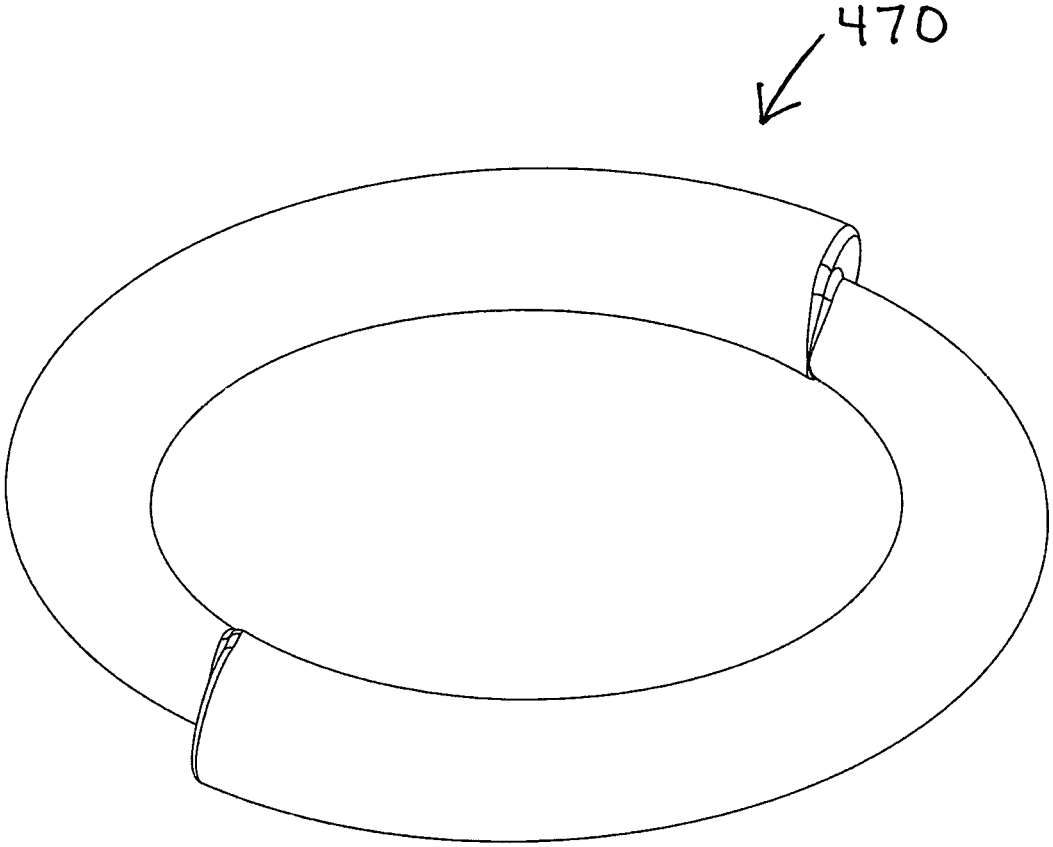
FIG. 15 is a perspective view of another weight constructed accordingly to the principles of the present invention.
Figures 16A, 16B, 16C, 16D, 16E, 16F:
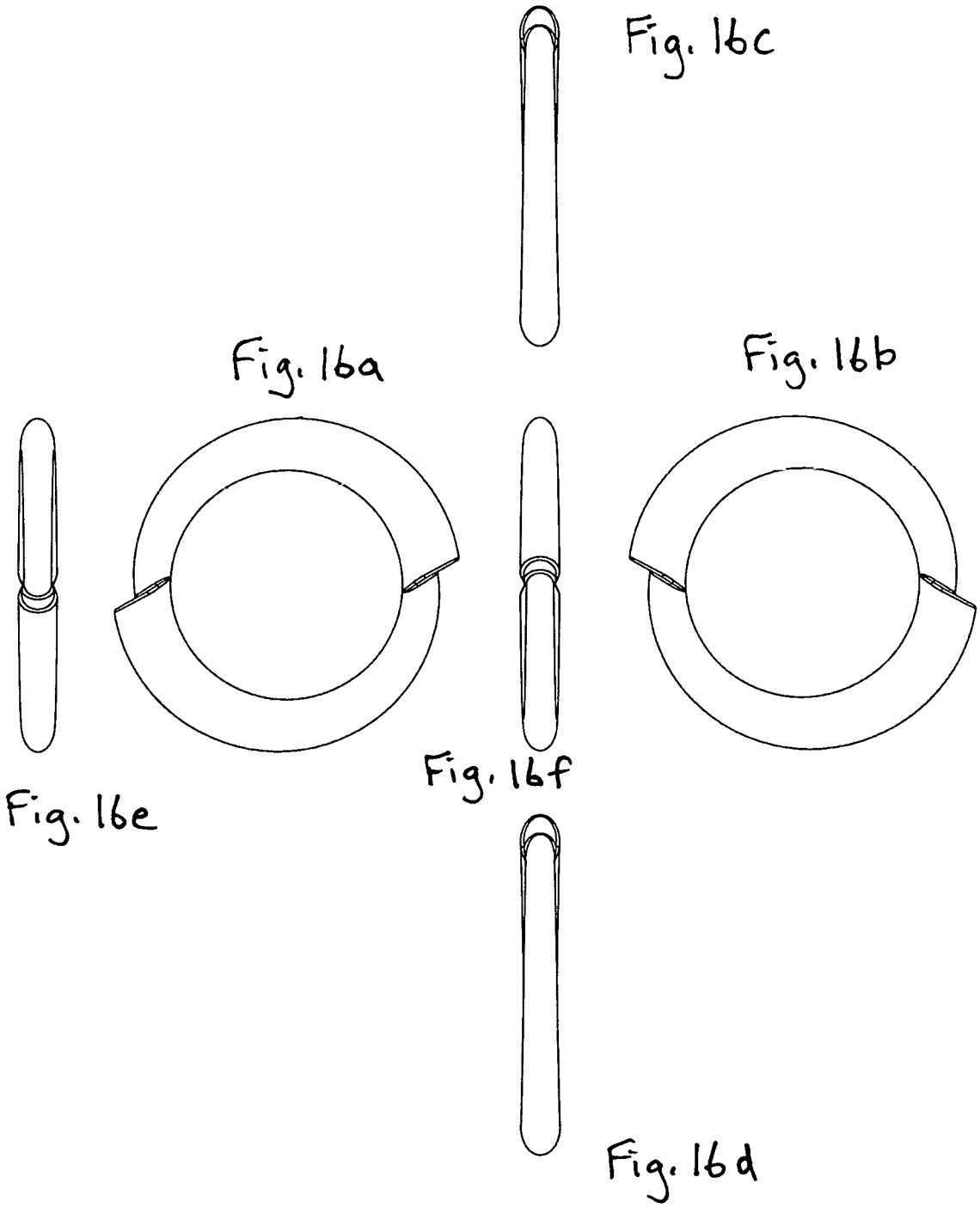
FIG. 16*a* is a front view of the weight of FIG. 15.
FIG. 16*b* is a back view of the weight of FIG. 15.
FIG. 16*c* is a top view of the weight of FIG. 15.
FIG. 16*d* is a bottom view of the weight of FIG. 15.
FIG. 16*e* is a side view of the weight of FIG. 15.
FIG. 16*f* is an opposite side view of the weight of FIG. 15.

FIGS. 15-17 show a weight 470 that may be described as a modified version of the weight 460, primarily in terms of reversing the angles of the interface lines to create more forgiving transitions at the junctures between the two handgrip segments. FIGS. 16*a*-16*f* show the six standard orthogonal views of the weight 470. FIG. 17 is a sectioned view of the weight 470 taken along a plane extending just to one side of both interfaces. The section is taken perpendicular to the circle defined by the weight 470, and passes through the smaller end of each segment.

As compared to the weight 460, the larger ends of the horn-shaped handgrip segments on the weight 470 are terminated by planes angled in an opposite direction. As a result, the weight 470 as shown in FIG. 16*b* can be stacked on top of the weight 460 as shown in FIG. 14, and the lower edges on the larger halves of the grip segments on the weight 470 will project beneath the upper edges on larger halves of the grip segments on the weight 460. This complementary stacking or nesting can be enhanced by providing the flat surface 418 (described above) on the face of the weight 460 as shown in FIG. 14 and on the face of the weight 170 as shown in FIG. 16*a*. Among other things, this stacking may facilitate more efficient shipping and/or storage of the two complementary weights 460 and 470, and/or handling of the two weights 460 and 470 as a single item when performing isometric exercises, for example.

FIG. 22 shows a weight 440 having first and second handgrip segments 441 and 442 arranged to eliminate the protrusions. In this regard, the smaller ends of the segments 441 and 442 abut one another at 12:00, and the larger ends of the segments 441 and 442 abut one another at 6:00. The weight 440 also may be described as a ring-shaped mass defined between two eccentrically arranged circles. The weight 440 is symmetrical about a plane represented by a line Q in FIG. 22. The weight 440 is similar in size and mass to the weights 400 and 450.

FIG. 23 shows a weight 444 that may be described as a modified version of the weight 440, primarily in terms of the manner of manufacture and the provision of protrusions 448 and 449 at 12:00 and 6:00, respectively. In this regard, the weight 444 has an outer shell 445 made of front and back injection molded plastic halves and secured together by conventional means, including sonic welding or adhesives, for example. A ballast ring 446, made by bending a cylindrical steel rod into a circle, is disposed inside the shell 445. The protrusions 448 and 449 are circular in cross-section with respective diameters that equal the major axes of the adjacent elliptical cross-sections. The weight 444 is similar in size to the weight 440 and weighs approximately half as much.

Figure 18:
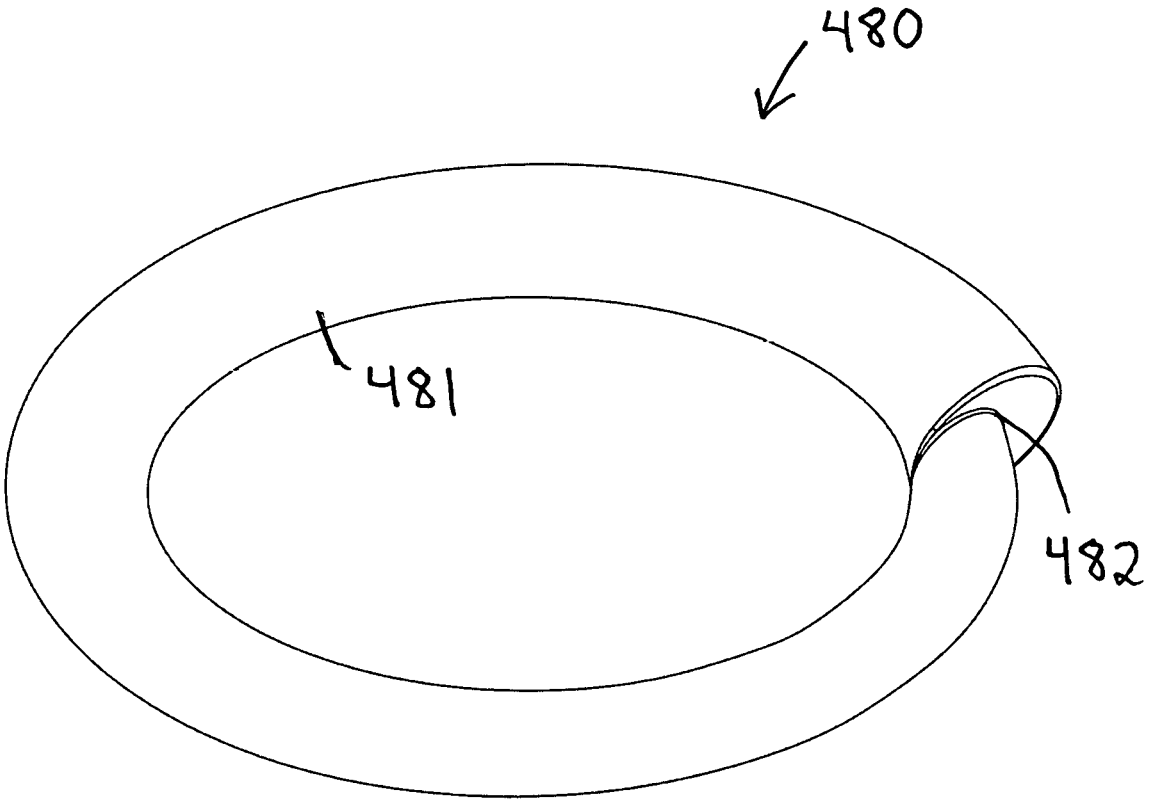
FIG. 18 is a perspective view of another weight constructed accordingly to the principles of the present invention.
Figure 19:
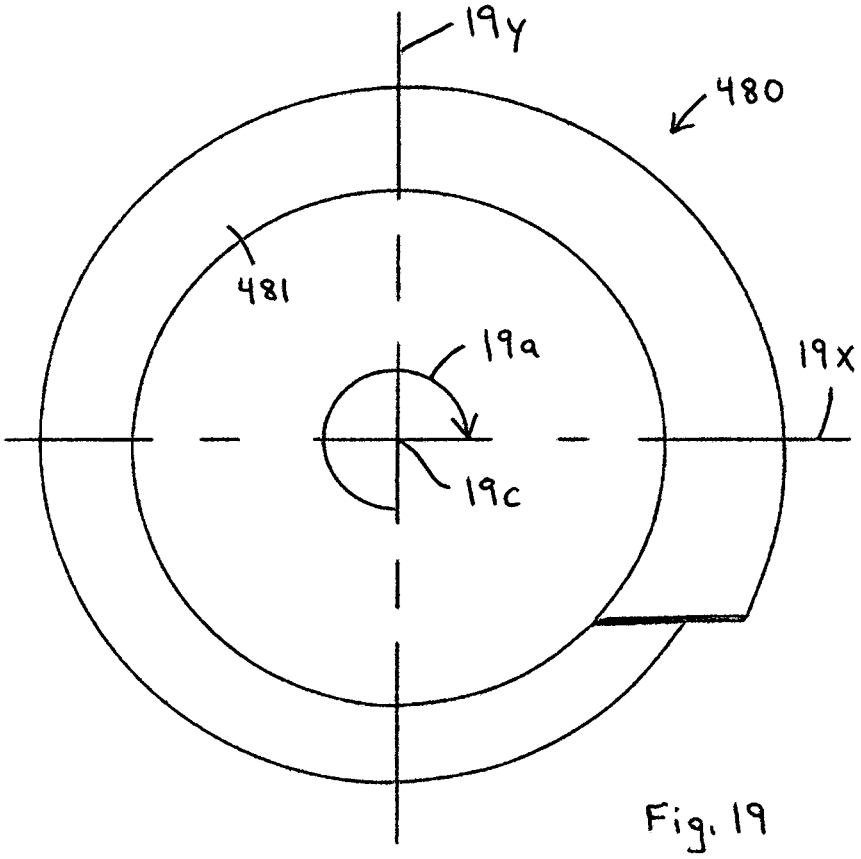
FIG. 19 is a front view of the weight of FIG. 18.

Alternative embodiments of the weights 400, 450, 460, and 470 may be made with relatively more or relatively fewer tapering handgrip segments. For example, FIGS. 18-19 show a weight 480 having a single handgrip segment 481 that gradually tapers from a large end to a small end. Like the aforementioned embodiments, the weight 480 is disposed about a central opening having a center point 19*c*, which is intersected by orthogonal axes 19*x* and 19*y*. The handgrip element 481 encircles the center point 19*c* and in doing so, curves in tapering fashion through an angle in excess of depicted angle 19*a*, which may be described as 270 degrees, at least 270 degrees, at least 150 degrees, and at least 90 degrees. At a juncture 482 defined between the ends, the single interface is more exaggerated or extreme than the ones shown in FIGS. 15-17. Also, the weight 480 must be made slightly larger than the weights 400 and 450 to arrive at the same mass.

Figure 20:
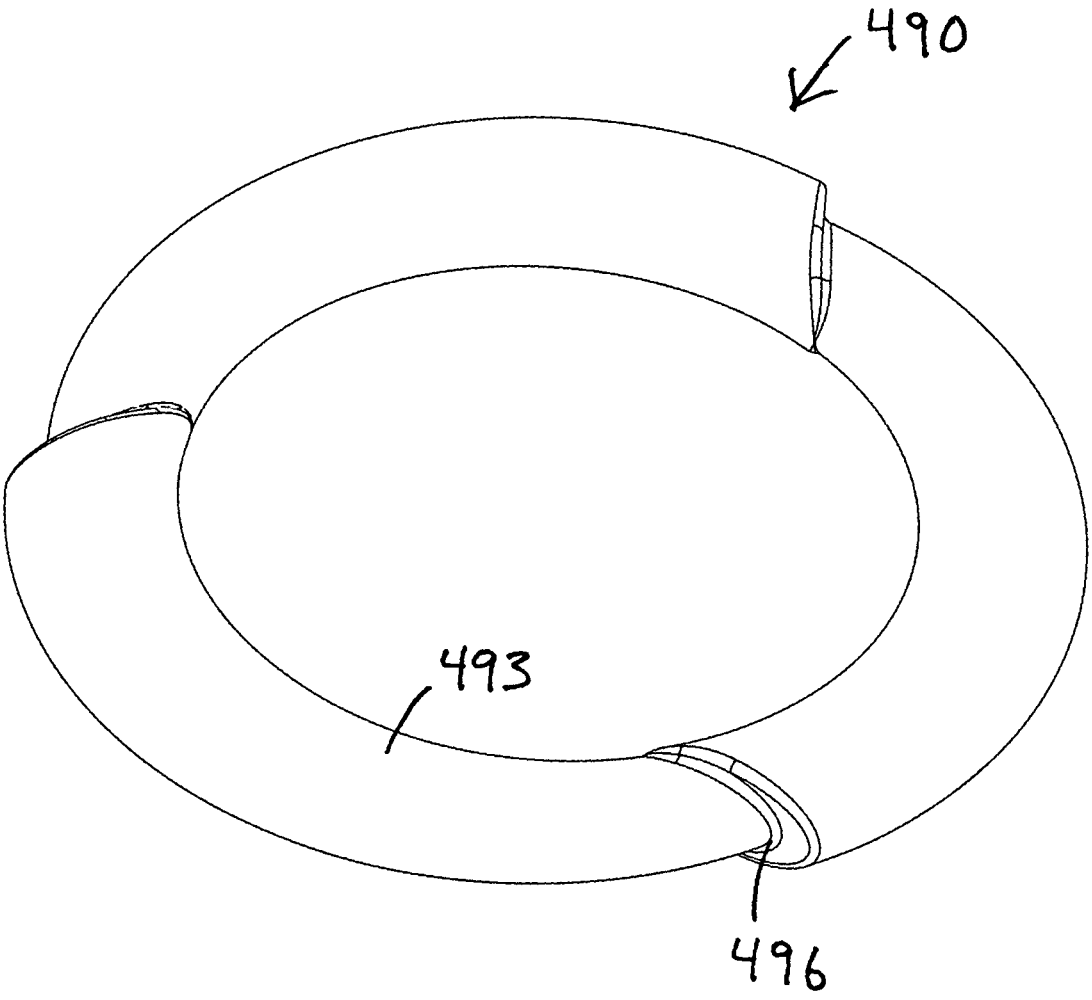
FIG. 20 is a perspective view of another weight constructed accordingly to the principles of the present invention.
Figure 21:
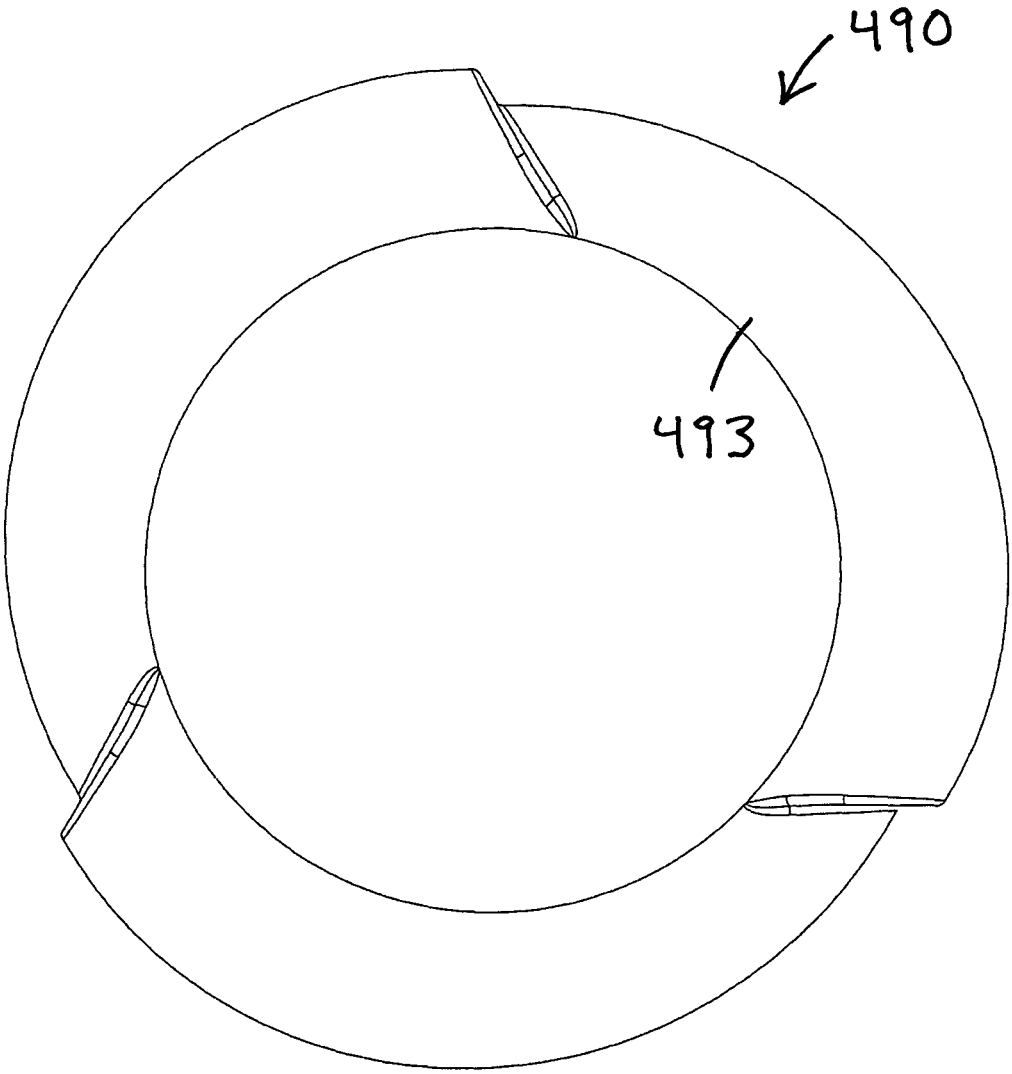
FIG. 21 is a front view of the weight of FIG. 20.

FIGS. 20-21 show a weight 490 having three identical handgrip segments 493, each of which has a small end that is connected to the large end of an adjacent segment. At junctures 496 defined between the ends, the three interfaces are less exaggerated than the ones shown in FIGS. 15-17. Also, the weight 490 must be made slightly smaller than the weights 400 and 450 to arrive at the same mass. Another alternative embodiment of the weight 440 may be made by arranging four tapered segments with adjacent small ends at 12:00 and 6:00 and adjacent large ends at 3:00 and 9:00.

Figure 1:
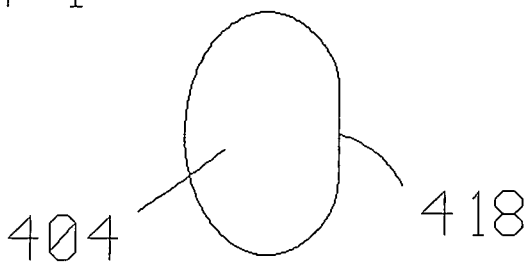
FIG. 1 is a cross-sectional view of a first handgrip profile suitable for use on various weights disclosed herein.
Figure 2:
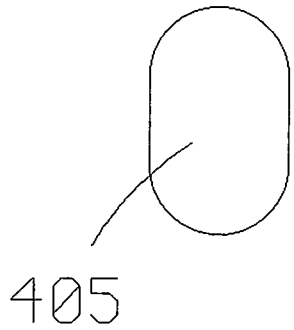
FIG. 2 is a cross-sectional view of a second handgrip profile suitable for use on various weights disclosed herein.
Figure 3:
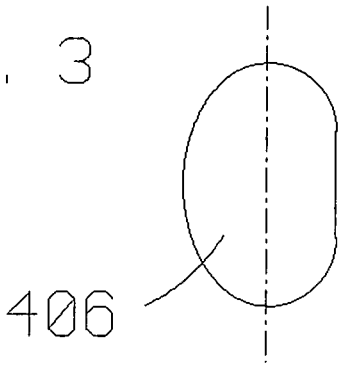
FIG. 3 is a cross-sectional view of a third handgrip profile suitable for use on various weights disclosed herein.

The weights 400, 440, 450, 460, 470, 480, and 490 are depicted with elliptical cross-sections of variable circumference. FIGS. 1-5 show some alternative cross-sections that can be substituted for any or all of the elliptical cross-sections to arrive at still more alternative embodiments of the present invention. In this regard, FIG. 1 shows a cross-section 404 that may be described as elliptical with the flat surface 418 cut into one side parallel to the major axis, and/or as elliptical on one side of the major axis and oval on the other side of the major axis (as further discussed below). FIG. 2 shows a cross-section 405 that is entirely oval. FIG. 3 shows a cross-section 406 that is one-half of the elliptical profile shown in FIG. 1 and one-half of the oval profile shown in FIG. 2 (divided along the major axis of the ellipse). The term "elliptival" is used herein to describe a profile or shape that combines elements from one ellipse and one oval. For example, the profiles shown in FIGS. 1 and 3 are elliptival profiles.

Figure 4:
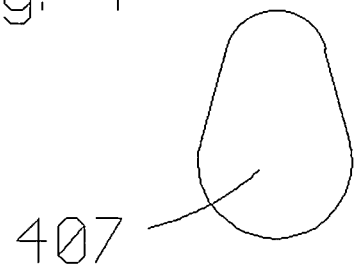
FIG. 4 is a cross-sectional view of a fourth handgrip profile suitable for use on various weights disclosed herein.
Figure 5:
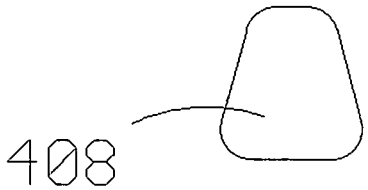
FIG. 5 is a cross-sectional view of a fifth handgrip profile suitable for use on various weights disclosed herein.

FIG. 4 shows a cross-section 407 that may be described as trapezoidal oval and/or as egg-shaped (and this particular cross-section can be arranged with the smaller rounded end facing inward on both hand grip segments, or with the smaller rounded end facing outward on both hand grip segments, or with different orientations on respective hand grip segments). FIG. 5 shows a cross-section 408 that is trapezoidal with rounded corners (and may be oriented in alternative ways, including those described above with reference to the egg-shaped cross section 407). The term "trapezeggal" is used herein to describe a trapezoid at one extreme, and an egg-shape at the other extreme, and any of various handgrip profiles ranging therebetween. Such trapezeggal profiles shall be characterized as having a relatively narrower end and a relatively wider end, like an egg or a trapezoid. Each end may be comprised of curved walls and/or straight walls, and the sidewalls extending therebetween may similar be comprised of curved walls and/or straight walls. For example, the profiles shown in FIGS. 4 and 5 are trapezeggal profiles.

Any one of the foregoing profiles may be used for the first segment of an alternative embodiment weight, and any one of the foregoing profiles may be used for the second segment of the same alternative embodiment. Still more alternative embodiment weights may be made using various combinations of the foregoing profiles but without tapering the segments from one end to the other.

FIG. 24 shows another weight 500 constructed according to the principles of the present invention. Generally speaking, the weight 500 is similar to the weight 400 in terms of overall size and mass, and may be described as a ring-shaped mass and/or as a torus disposed between two concentric circles. The weight 500 has three handgrip segments 510, 520, and 530 that define three discrete uniform cross-sections, each of which extends unchanged through one hundred twenty degrees or one-third of the circumference of the weight 500.

As shown in FIG. 25, the first handgrip segment 510 has a cross-sectional profile 511, taken at cross-section cut line 51. The profile 511 is convexly curved to the outside and to the inside of the weight 500, and has parallel flat surfaces on the front and back sides of the weight 500.

As shown in FIG. 26, the second handgrip segment 520 has a cross-sectional profile 522, taken at cross-section cut line 52, which may be described as trapezeggal. More specifically, the profile 522 is convexly curved to the outside and to the inside of the weight 500, and has converging flat surfaces on the front and back sides of the weight 500, and these flat surfaces converge toward the outside of the weight 500.

As shown in FIG. 27, the third handgrip segment 530 has a cross-sectional profile 533, taken at cross-section cut line 53, which may be described as trapezeggal. More specifically, the profile 533 is convexly curved to the outside and to the inside of the weight 500, and has converging flat surfaces on the front and back sides of the weight 500, and these flat surfaces converge toward the inside of the weight 500. In other words, the profile 533 is a mirrored version of the profile 522.

The three different profiles give a user options to select a most preferred handgrip and/or different handgrips for specific exercises. Optional junctures or protrusions 512 are disposed between adjacent segments 510, 520, and 530 to provide breaks or stops that a user can "feel for" while holding the weight 500 and/or spinning the weight 500. Each juncture 512 is a circle having a diameter equal to the maximum distance between in the inner and outer curves on each of the profiles 511, 522, and 533.

There are several ways to manufacture weights in accordance with the principles of the present invention. One such method is to make a weight a unitary part of solid cast metal (with or without interior chambers). Such a part may optionally be encased inside a vinyl coating, for example. Another method is to secure ballast weight (preferably metal) inside an injection molded plastic shell. Yet another method is to over-mold a "foamed" material over a ballast weight (preferably metal). In some of these instances, the resulting weight may be described as entirely rigid, as is the case with a unitary piece of metal. In other cases, the resulting weight may be described as internally rigid, as is the case with a metal core surrounded by vinyl or foam (meaning the outer surface may resiliently deflect, but the internal core remains a fixed structure). The term "internally rigid" shall mean that when diametrically opposed forces of fifty pounds are applied against diametrically opposed, outwardly facing portions of the weight, the shape of the weight's inner ring is unaffected, and when diametrically opposed forces of fifty pounds are applied against diametrically opposed, inwardly facing portions of the weight, the shape of the weight's outer ring is unaffected.

Certain embodiments of the present invention may be described in terms of hand-held exercise free weights comprising a bar configured and arranged to curve about a central opening, and defining (a) a first handgrip at a first circumferential location about the central opening, (b) a second handgrip at a second circumferential location about the central opening, and (c) a third handgrip at a third circumferential location about the central opening, wherein the central opening extends to each said handgrip, and each said handgrip defines a different, circumferentially extending profile sized and configured to be separately grasped in a person's hand.

The bar may be described as defining a closed curve sized and configured to accommodate a person maintaining a loose grasp around the bar while rotating the bar about the central opening to cycle each said handgrip into and out of the person's grasp, and/or as extending in an uninterrupted manner that allows a person to maintain a loose grasp around the bar while rotating the bar about the central opening to cycle each said handgrip into and out of the person's grasp.

The bar may be described as defining a protrusion disposed in series between the first handgrip and the second handgrip, and with a protrusion profile that is different than both the profile of the first handgrip and the profile of the second handgrip, and further, as defining a second protrusion disposed in series between the second handgrip and the third handgrip, and each said protrusion defines the same said protrusion profile.

Each handgrip may be described as defining an equal arc length about the central opening. A reference line may be described as extending diametrically through the central opening, bisects the first handgrip, and passes between the second handgrip and the third handgrip.

Certain embodiments of the present invention may be described in terms of a hand-held exercise free weight, comprising a bar configured and arranged to curve about a central opening, wherein the bar defines three handgrips, including (a) a first handgrip disposed at a first circumferential location about the central opening, (b) a second handgrip disposed at a second circumferential location about the central opening, and (c) a third handgrip disposed at a third circumferential location about the central opening, wherein the central opening extends to each said handgrip, and each said handgrip is sized and configured to be grasped in a person's hand, and a reference plane spans the central opening entirely to one side of all three handgrips, and the bar also defines three protrusions, including (a) a first protrusion disposed in series between the first handgrip and the second handgrip, (b) a second protrusion disposed in series between the second handgrip and the third handgrip, and (c) a third protrusion disposed in series between the third handgrip and the first handgrip, wherein the central opening extends to each said protrusions, and the reference plane intersects all three protrusions. A second reference plane may be described as extending entirely to said one side of all three handgrips and tangent to all three protrusions, thereby defining respective gaps between the handgrips and the second reference plane.

The bar may be described as defining an inwardly facing curve that encircles the central opening, and/or as defining an outwardly facing curve that encircles the bar. The bar may be described as sized and configured to allow a person to maintain a loose grasp around the bar while rotating the bar about the central opening to cycle each said handgrip into and out of the person's hand.

Certain embodiments of the present invention may be described in terms of a hand-held exercise free weight, consisting essentially of a bar configured in a curve about a single central opening large enough to accommodate a person's hand grasping the bar in a plurality of alternative, circumferentially spaced locations along the bar, including a first location, where the bar defines a first cross-sectional profile, and a second location, where the bar defines a second cross-sectional profile, wherein each said profile extends through an arc of at least ninety degrees. Each said profile may be described as increasing in circumference as a function of displacement along a respective said arc.

Certain embodiments of the present invention may be realized by incorporating additional features into some or all of the embodiments already disclosed herein. For example, the two handgrip segments of the weight 400 may be manufactured separately and then interconnected to form a selectively opening loop. In this regard, each smaller end may be snapped fitted and/or latched inside an adjacent larger end, or in the alternative, one such end could be hinged.

Certain embodiments of the present invention may be described in terms of a hand-held exercise free weight, consisting essentially of a bar configured and arranged to form a circular loop about a central opening, wherein the bar defines two mutually exclusive handgrips, including (a) a first handgrip disposed at a first circumferential location about the central opening, (b) a second handgrip disposed at a second circumferential location about the central opening, wherein each said handgrip is sized and configured to be grasped in a person's hand, (c) a first break disposed at a first interface between the first handgrip and the second handgrip, and (d) a second break disposed at a second interface between the first handgrip and the second handgrip, wherein the second break and the first break are on diametrically opposite sides of the central opening.

Certain embodiments of the present invention may be described in terms of a hand-held exercise free weight, consisting essentially of a bar configured in a circular loop about a single central opening large enough to accommodate a person's hand grasping the bar in a plurality of alternative, circumferentially spaced locations along the bar, including a first location, where the bar defines a first cross-sectional profile, and a second location, where the bar defines a second cross-sectional profile, wherein the first cross-sectional profile is different than the second cross-sectional profile at a juncture defined therebetween.

The subject invention has been described with reference to specific embodiments and particular applications with the understanding that features of the subject invention may be practiced individually and/or in various combinations. Also, persons skilled in the art will recognize that various modifications may be made to the depicted embodiments and/or their applications without departing from the scope of the subject invention. For example, a feature shown on one embodiment may be added to or substituted for a feature on another embodiment. Also, the size and/or density of the weights may be adjusted to accommodate different demographics. In view of the foregoing, the subject invention should be limited only to the extent of allowable claims that issue from this application or any related application.

What is claimed is:

1. A hand-held exercise free weight configured to be held in a person's hand while performing an exercise, comprising a handgrip segment that continuously shrinks in girth as it curves from a large girth end to a small girth end through an angle of at least 270 degrees about a central opening, thereby defining a range of handgrip options that continuously shrink in girth from the large girth end to the small girth end.

2. The exercise free weight of claim 1, wherein the handgrip segment encircles the central opening, and the small girth end and the large girth end abut to define a juncture defined therebetween.

3. The exercise free weight of claim 1, wherein the handgrip segment defines a cross-sectional profile having a perimeter that is at least one-half elliptical with a major axis that is approximately ¾ inch at the small girth end and approximately 1.25 inches a the large girth end.

4. The exercise free weight of claim 1, wherein the handgrip segment continuously shrinks in both a first direction, perpendicular to the angle of at least 270 degrees, and a second direction, perpendicular to the first direction.

5. The exercise free weight of claim 1, wherein the central opening defines a diameter between four inches and five and one-half inches.

6. The exercise free weight of claim 1, wherein the handgrip segment is a metal bar encased inside a coating.

7. A hand-held exercise free weight configured to be held in a person's hand while performing an exercise, comprising an internally rigid loop disposed about a central opening having a plurality of intersecting diameters, wherein the rigid loop includes a handgrip segment sized and configured to be grasped in a person's hand while performing an exercise, and said handgrip segment defines diametrically oriented cross-sectional profiles that are egg-shaped and continuously shrink in both maximum height and maximum width as said handgrip segment curves through at least 150 degrees about the central opening.

8. The exercise free weight of claim 7, wherein the rigid loop includes a second said handgrip segment, and each said handgrip segment has a respective small girth end and a respective large girth end.

9. The exercise free weight of claim 8, wherein the first handgrip segment is identical to the second handgrip segment.

10. The exercise free weight of claim 8, wherein the small girth end of the first handgrip segment and the large girth end of the second handgrip segment abut to define a first juncture, and the large girth end of the first handgrip segment and the small girth end of the second handgrip segment abut to define a second juncture.

11. The exercise free weight of claim 8, wherein the small girth end of the first handgrip segment abuts the small girth end of the second handgrip segment, and the large girth end of the first handgrip segment abuts the large girth end of the second handgrip segment.

12. The exercise free weight of claim 7, wherein the diameters are between four inches and five and one-half inches.

13. The exercise free weight of claim 7, wherein said handgrip segment curves through 360 degrees between a small girth end and a large girth end that abut to define a juncture.

14. The exercise free weight of claim 7, wherein said handgrip segment is a metal bar encased inside a coating.

15. A hand-held exercise free weight configured to be held in a person's hand while performing an exercise, comprising a metal handgrip segment that curves through an arc of at least 150 degrees about a central opening, wherein as a function of circumferential displacement about the central opening, the handgrip segment gradually tapers in girth from a large girth end to a small girth end, and the handgrip segment defines a shrinking cross-sectional profile, and at least one-half of the shrinking cross-sectional profile is bounded by a shrinking ellipse having a major axis that measures approximately ¾ inch at the small girth end and approximately 1.25 inches at the large girth end.

16. The exercise free weight of claim 15, wherein all of the cross-sectional profile is bounded by said shrinking ellipse, and said shrinking ellipse has a minor axis that measures approximately ½ inch at the small girth end and a minor axis that measures approximately ¾ inch at the large girth end.

17. The exercise free weight of claim 15, wherein a first half of the cross-sectional profile is bounded by said shrinking ellipse, and an opposite, second half of the cross-sectional profile is bounded by a shrinking oval.

18. The exercise free weight of claim 15, further comprising an identical second said metal handgrip segment rigidly connected to the first said metal handgrip segment to occupy a diametrically opposite location relative to the central opening.

19. The exercise free weight of claim 15, wherein the metal handgrip segment forms a closed loop about the central opening with the small girth end abutting the large girth end.

20. A hand-held exercise free weight, comprising a bar configured and arranged to form a closed curve about a central opening, wherein the bar defines a single continuous handgrip that (a) extends from a first end to a second end, (b) defines a circle about the central opening with the first end abutting the second end, and (c) defines a cross-sectional profile that gradually increases in size from the first end to the second end, thereby defining a range of handgrip options that grow in girth from the first end to the second end.

* * * * *